US011820625B2

(12) United States Patent
Garcia et al.

(10) Patent No.: US 11,820,625 B2
(45) **Date of Patent: *Nov. 21, 2023**

(54) FLEXIBLE PIPE HANDLING SYSTEM AND METHOD OF USING SAME

(71) Applicant: TRINITY BAY EQUIPMENT HOLDINGS, LLC, Houston, TX (US)

(72) Inventors: Ricardo Garcia, Houston, TX (US); Jonathan Guerrero, Houston, TX (US); Matthew Allen Hegler, Kingwood, TX (US); John Leger, Baytown, TX (US); Matthew Lousteau, Houston, TX (US); Juan Moreno, Houston, TX (US); Jagtar Thethy, Houston, TX (US); Alexander Lee Winn, Houston, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/094,478

(22) Filed: Jan. 9, 2023

(65) Prior Publication Data

US 2023/0150791 A1 May 18, 2023

Related U.S. Application Data

(63) Continuation of application No. 17/231,787, filed on Apr. 15, 2021, now Pat. No. 11,548,755, which is a continuation of application No. 16/793,695, filed on Feb. 18, 2020, now Pat. No. 11,059,693.

(60) Provisional application No. 62/806,748, filed on Feb. 15, 2019.

(51) Int. Cl.
*B65H 75/24* (2006.01)
*B65H 75/20* (2006.01)

(52) U.S. Cl.
CPC ..... *B65H 75/243* (2013.01); *B65H 75/20* (2013.01)

(58) Field of Classification Search
None
See application file for complete search history.

(56) References Cited

U.S. PATENT DOCUMENTS 9,617,112 B1 * 4/2017 Temblador ..... B65H 75/22
11,059,693 B2 * 7/2021 Garcia ..... B65H 75/242

* cited by examiner

*Primary Examiner* — William A. Rivera
(74) *Attorney, Agent, or Firm* — Greenberg Traurig, LLP; Dwayne Mason

(57) ABSTRACT

A system includes a drum assembly that includes a support bar having a first end and a second end, and a plurality of drum segments coupled to the support bar. The drum segments are movable between retracted and extended positions, and the drum assembly is configured to be disposed within an interior region of a coil of flexible pipe when the plurality of drum segments are in the retracted position. The system also includes a first containment flange coupled to the drum assembly at the first end, a second containment flange coupled to the drum assembly at the second end, a first coupling device configured to removably couple the first containment flange to the drum assembly, and a second coupling device configured to removably couple the second containment flange to the drum assembly. The first and second containment flanges are configured to contain the flexible pipe.

19 Claims, 13 Drawing Sheets

FLEXIBLE PIPE HANDLING SYSTEM AND METHOD OF USING SAME

BACKGROUND

Flexible pipe is useful in a myriad of environments, including in the oil and gas industry. Flexible pipe may be durable and operational in harsh operating conditions and can accommodate high pressures and temperatures. Flexible pipe may be bundled and arranged into one or more coils to facilitate transporting and using the pipe.

Coils of pipe may be positioned in an "eye to the side" or "eye to the sky" orientation. When the flexible pipe is coiled and is disposed with its interior channel facing upwards, such that the coil is in a horizontal orientation, then the coils of pipe are referred to as being in an "eye to the sky" orientation. If, instead, the flexible pipe is coiled and disposed such that the interior channel is not facing upwards, such that the coil is in an upright or vertical orientation, then the coils of pipe are referred to as being in an "eye to the side" orientation.

The flexible pipe may be transported as coils to various sites for deployment (also referred to as uncoiling or unspooling). Different types of devices and vehicles are currently used for loading and transporting coils of pipe, but usually extra equipment and human manual labor is also involved in the process of loading or unloading such coils for transportation and/or deployment. Such coils of pipe are often quite large and heavy. Accordingly, there exists a need for an improved method and apparatus for loading and unloading coils of pipe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a system that includes a drum assembly that includes a support bar having a first end and a second end, and a plurality of drum segments coupled to the support bar. The plurality of drum segments are movable between a retracted position and an extended position, and the drum assembly is configured to be disposed within an interior region of a coil of flexible pipe when the plurality of drum segments are in the retracted position. The system also includes a first containment flange coupled to the drum assembly at the first end, and a second containment flange coupled to the drum assembly at the second end. The first and second containment flanges are configured to contain the flexible pipe disposed on the drum assembly between the first and second containment flanges. The system also includes a first coupling device configured to removably couple the first containment flange to the drum assembly and a second coupling device configured to removably couple the second containment flange to the drum assembly.

In another aspect, embodiments of the present disclosure relate to a method of engaging a drum assembly with a coil of flexible pipe that includes disposing the drum assembly within an interior region of the coil of flexible pipe. The drum assembly includes a support bar having a first end and a second end, and a plurality of drum segments coupled to the support bar. The plurality of drum segments are movable between a retracted position and an extended position, and the drum assembly is configured to be disposed within an interior region of a coil of flexible pipe when the plurality of drum segments are in the retracted position. The method also includes moving the plurality of drum segments from the retracted position to the extended position, removably coupling a first containment flange to the drum assembly at the first end via a first coupling device, removably coupling a second containment flange to the drum assembly at the second end via a second coupling device, and containing the flexible pipe disposed on the drum assembly between the first and second containment flanges.

Other aspects and advantages of the claimed subject matter will be apparent from the following description and the appended claims.

DETAILED DESCRIPTION

Figure 1:
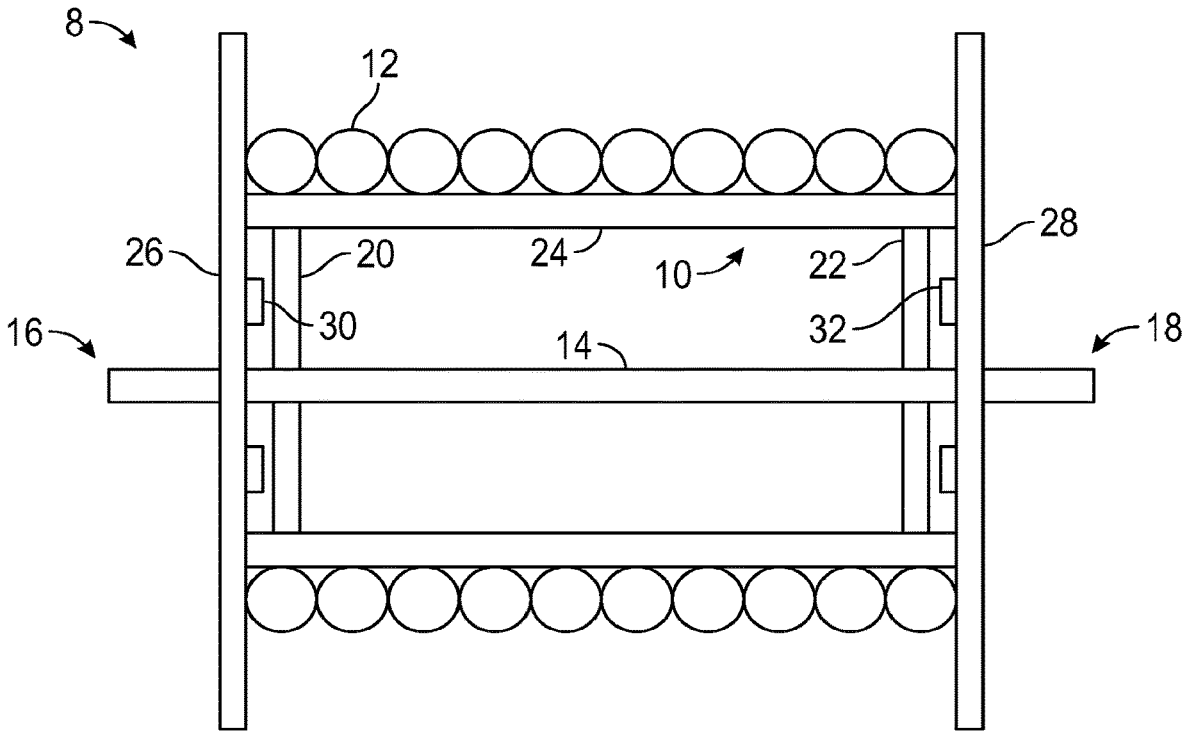
FIG. 1 is a block diagram of a flexible pipe handling system that includes a drum assembly according to embodiments of the present disclosure.

Embodiments of the present disclosure relate generally to systems used for deploying coils of flexible pipe. The coils of pipe may be self-supported, for example, using bands to hold coils together. Flexible pipe handling system according to embodiments of the present disclosure may include a drum assembly, containment flanges coupled to the drum assembly, and coupling devices configured to removably couple the containment flanges to the drum assembly. The drum assembly may include a support bar and a plurality of drum segments coupled to the support bar. The plurality of drum segments are movable between retracted and extended positions, and the drum assembly is configured to be disposed within an interior region of the coil of flexible pipe when the plurality of drum segments are in the retracted position.

Embodiments of the present disclosure will be described below with reference to the figures. In one aspect, embodiments disclosed herein relate to embodiments for handling coils using flexible pipe handling systems.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

FIG. 1 illustrates a block diagram of an embodiment of a flexible pipe handling system 8 that includes a drum assembly 10. As described in detail below, spoolable pipe 12 may be disposed about the drum assembly 10 to enable handling of the spoolable pipe 12. Spoolable pipe 12 may refer to any type of flexible pipe or piping capable of being bent into a coil. Such coils of spoolable pipe 12 may reduce the amount of space taken up by pipe during manufacturing, shipping, transportation, and deployment compared to rigid pipe that is not capable of being bent into a coil.

Pipe, as understood by those of ordinary skill, may be a tube to convey or transfer any water, gas, oil, or any type of fluid known to those skilled in the art. The spoolable pipe 12 may be made of any type of materials including without limitation plastics, metals, a combination thereof, composites (e.g., fiber reinforced composites), or other materials known in the art. One type of spoolable pipe 12 is flexible pipe, which is used frequently in many applications, including without limitation, both onshore and offshore oil and gas applications. Flexible pipe may include Bonded or Unbonded Flexible Pipe, Flexible Composite Pipe (FCP), Thermoplastic Composite Pipe (TCP) or Reinforced Thermoplastic Pipe (RTP). A FCP or RTP pipe may itself be generally composed of several layers. In one or more embodiments, a flexible pipe may include a high-density polyethylene ("HDPE") liner having a reinforcement layer and an HDPE outer cover layer. Thus, flexible pipe may include different layers that may be made of a variety of materials and also may be treated for corrosion resistance. For example, in one or more embodiments, pipe used to make up a coil of pipe may have a corrosion protection shield layer that is disposed over another layer of steel reinforcement. In this steel-reinforced layer, helically wound steel strips may be placed over a liner made of thermoplastic pipe. Flexible pipe may be designed to handle a variety of pressures, temperatures, and conveyed fluids. Further, flexible pipe may offer unique features and benefits versus steel/carbon steel pipe lines in the area of corrosion resistance, flexibility, installation speed and re-usability. Another type of spoolable pipe is coiled tubing. Coiled tubing may be made of steel. Coiled tubing may also have a corrosion protection shield layer.

The drum assembly 10 of FIG. 1 also includes a support bar 14 having a first end 16 and a second end 18. The support bar 14 is used to handle the drum assembly 10 and various components are coupled to the support bar 14, as described in further detail below. In certain embodiments, a first plurality of expandable spokes 20 are coupled to the support bar 14 proximate the first end 16 and a second plurality of expandable spokes 22 are coupled to the support bar 14 proximate the second end 18. In addition, each of a plurality of drum segments 24 are mounted to the first plurality of expandable spokes 20 and the second plurality of expandable spokes 22. The drum segments 24 extend parallel to the support bar 14. The plurality of drum segments 24 are used to support the spoolable pipe 12 and are movable between retracted and extended positions, as described in more detail below. Thus, the drum assembly 10 is configured to be easily inserted and withdrawn from coils of spoolable pipe 12 and to be used with coils of spoolable pipe 12 of different inner diameters.

The flexible pipe handling system 8 shown in FIG. 1 also includes a first containment flange 26 coupled to the drum assembly 10 at the first end 16 and a second containment flange 28 coupled to the drum assembly 10 at the second end 18. The first and second containment flanges 26 and 28 help to contain the spoolable pipe 12 disposed on the drum assembly 10 between the first and second containment flanges 26 and 28 as described in more detail below. In the illustrated embodiment, a first coupling device 30 is used to removably couple the first containment flange 26 to the drum assembly 10 and a second coupling device 32 is used to removably couple the second containment flange 28 to the drum assembly 10. The function and components of the first and second coupling devices 30 and 32 are described in more detail below. In certain embodiments, the first and second containment flanges 26 and 28 may be interchangeable meaning the first containment flange 26 may be coupled at the second end 18 and the second containment flange 28 may be coupled at the first end 16. In further embodiments, the first and second containment flanges 26 and 28 may be identical to each other and in other embodiments, the first and second containment flanges 26 and 28 may be different from one another.

Figure 2:
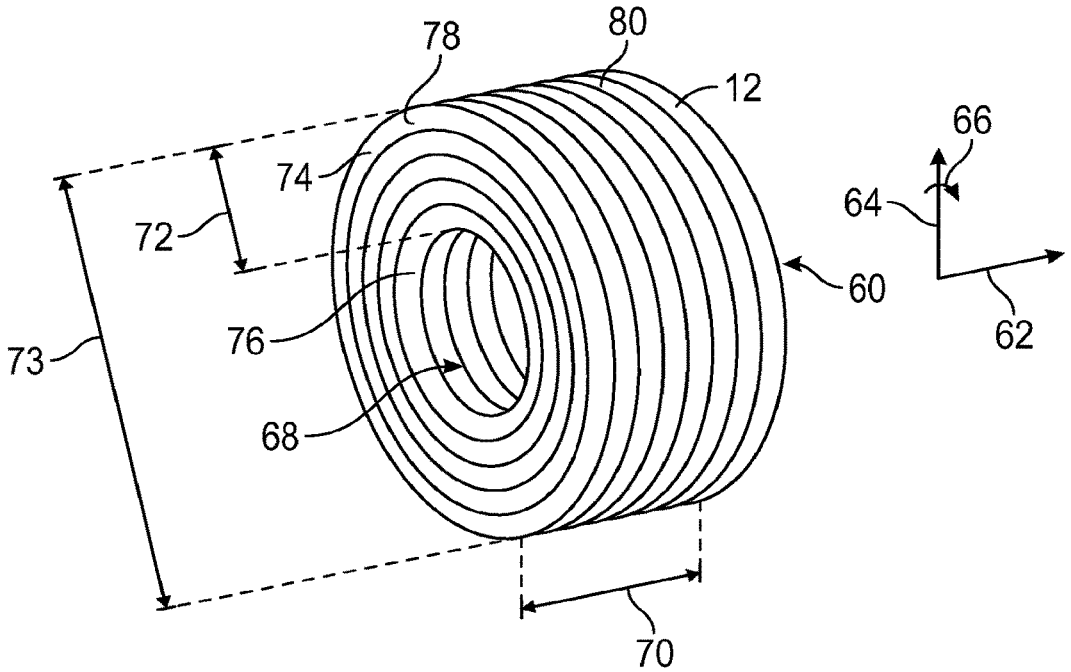
FIG. 2 is a perspective view of a coil of spoolable pipe according to embodiments of the present disclosure.

FIG. 2 illustrates a perspective view of an embodiment of a coil 60 of spoolable pipe 12. The coil 60 may be defined by an axial axis or direction 62, a radial axis or direction 64, and a circumferential axis or direction 66. The coil 60 may be formed by wrapping the spoolable pipe 12 into a coil with an interior channel 68 formed axially 62 therethrough, where the coil 60 may be moved as a single package or bundle of coiled pipe, as shown in FIG. 2. Each complete turn of coiled pipe may be referred to as a wrap of pipe. Multiple wraps of pipe in the coil 60 may be configured in columns along the axial direction 62 of the coil 60 and/or configured in layers along the radial direction 64 of the coil 60. For example, multiple columns of wraps may be formed along the axial direction 62 of the coil 60, where an axial dimension 70 of the coil 60 is based on the diameter of the pipe 12 and the number and axial 62 position of wraps forming the coil 60. Further, multiple layers of wraps may be formed along the radial direction 64 of the coil 60, where a radial dimension 72 of the coil 60 is based on the diameter of the pipe and the number and radial 64 position of the wraps forming the coil 60. The coil 60 may also be defined by a diameter 73. In certain embodiments, a weight of the coil 60 may exceed 40,000 pounds (18,144 kilograms), or exceed 60,000 pounds (27,216 kilograms).

As shown in FIG. 2, the coil 60 of spoolable pipe 12 may be one or more layers (e.g., layers 74 and 76) of pipe packaged or bundled into the coil 60. The coil 60 may include at least one or more layers of pipe that have been coiled into a particular shape or arrangement. As shown in FIG. 2, the coil 60 is coiled into a substantially cylindrical shape having substantially circular bases 78 and 80 formed on each end of the coil 60, where the axial dimension 70 of the coil 60 is measured between the two bases 78 and 80.

As known to those of ordinary skill in the art, the spoolable pipe 12 used to make up the coil 60 shown in FIG. 2 may be coiled using spoolers or other coiler machines suited for such a function. Those of ordinary skill will recognize that the present disclosure is not limited to any particular form of coiler or other device that may be used to form pipe into a coil. Winding pipe into a coil, such as 60, assists when transporting pipe, which may be several hundred feet in length in one or more embodiments. Further, the coil 60 may be wound to facilitate deployment of the coil. Deployment, as used herein, may refer to the action of unspooling or unwinding the spoolable pipe 12 from the coil 60.

After being assembled into a coil, the coil 60 shown in FIG. 2 may include the interior channel 68 formed axially 62 through the coil 60. The interior channel 68 is a bore disposed generally in the center of the coil 60. The interior channel 68 may be substantially circular-shaped. The coil 60 may have an outer diameter (OD) and an inner diameter (ID), where the inner diameter is defined by the interior channel 68.

Figure 3:
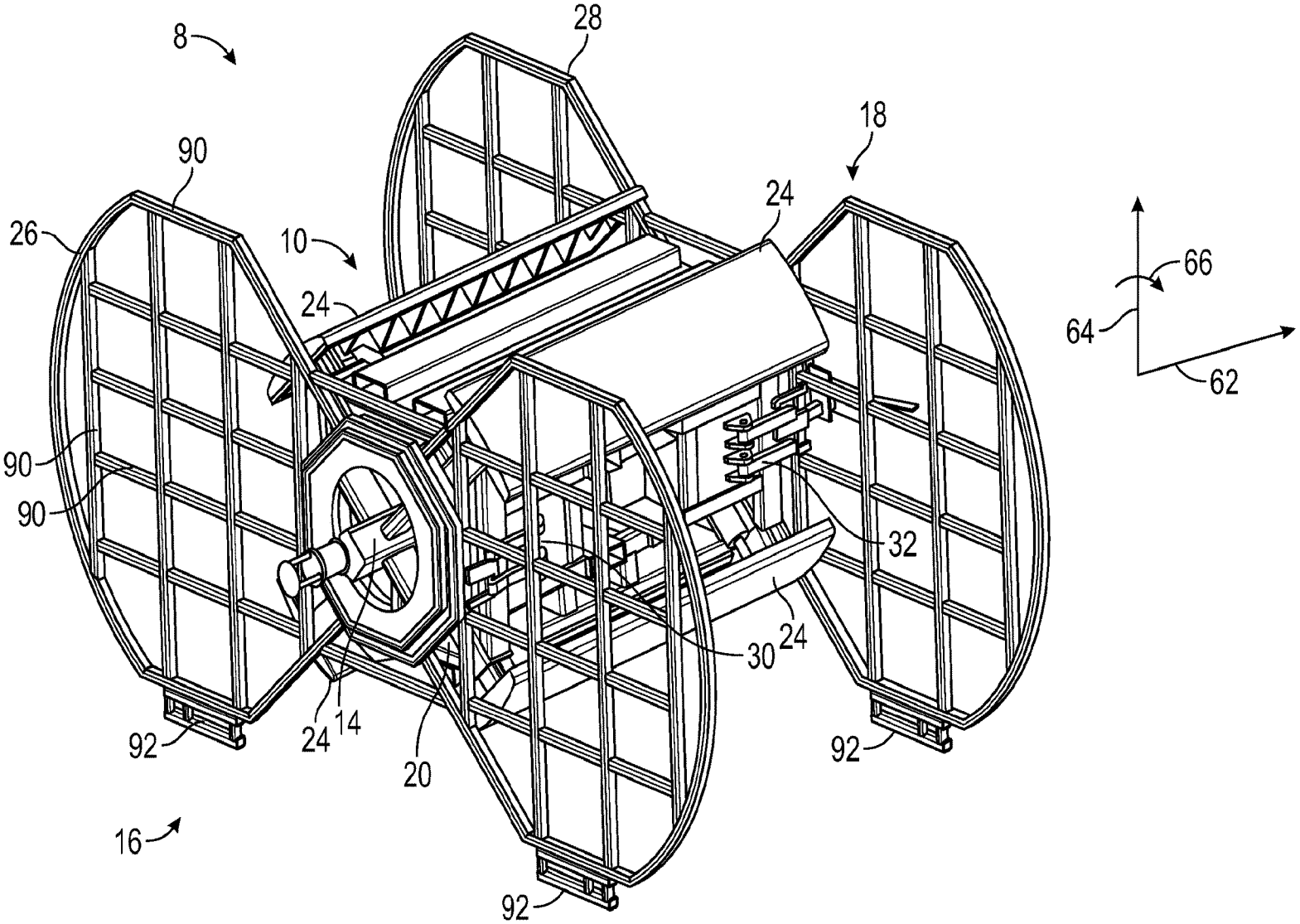
FIG. 3 is a perspective view of a flexible pipe handling system according to embodiments of the present disclosure.

FIG. 3 illustrates a perspective view of an embodiment of the flexible pipe handling system 8. Elements in common with those shown in FIG. 1 are labeled with the same reference numerals. In the illustrated embodiment, the drum assembly 10 includes four drum segments 24 coupled to the support bar 14 via the first plurality of expandable spokes 20 and the second plurality of expandable spokes 22 (not shown). Although four drum segments 24 are shown in FIG. 3, other embodiments of the drum assembly 10 may include different numbers of drum segments, such as, but not limited to, two, three, six, or eight drum segments 24. When the drum segments 24 are in the extended position, one or more of the drum segments 24 are in contact with the coil 60 with enough pressure on the interior channel 68 such that the coil 60 is secured to the drum assembly 10. Outer surfaces of the plurality of drum segments 24 may have a cross-sectional shape generally conforming with the curved shaped of the interior channel 68, thereby evenly distributing the pressure across the interior channel 68. In other words, the drum segments 24 may have a semi-circular shape to correspond to the semi-circular shape of the interior channel 68. Thus, the expanded drum assembly 10 may be used to fully support the coil 60, such as during handling and deployment of the coil 60. In particular, the expanded drum assembly 10 and coil 60 can be handled in a similar manner to spoolable pipe 12 disposed on a reel or spool. However, one drum assembly 10 may be used to handle many coils 60 without the logistics associated with empty reels or spools. In addition, use of the drum assembly 10 enables heavier coils 60 of spoolable pipe 12 to be handled and transported because the weight of reels or spools is not involved.

As shown in FIG. 3, the first and second containment flanges 26 and 28 are configured in an open framework that includes a plurality of beams 90 coupled to one another. An open framework such as that shown in FIG. 3 may provide adequate strength and stability to the first and second containment flanges 26 and 28 without the added weight and cost associated with a solid containment flange. In certain embodiments, the first and second containment flanges 26 and 28 may include a containment flange extension 92 located on one or both sides of the first and second containment flanges 26 and 28 (e.g., bottom or both top and bottom). The containment flange extensions 92 may be used with a support leg (not shown) to maintain the first and second containment flanges 26 and 28 in upright position when not coupled to the drum assembly 10 as described in more detail below. The containment flange extensions 92 may be coupled to the first and second containment flanges 26 and 28 removably or permanently via various techniques, such as, screws, bolts, clamps, welding, brazing, or other fastening techniques. Details regarding the first and second coupling devices 30 and 32 shown in FIG. 3 are described in more detail below.

Figure 4:
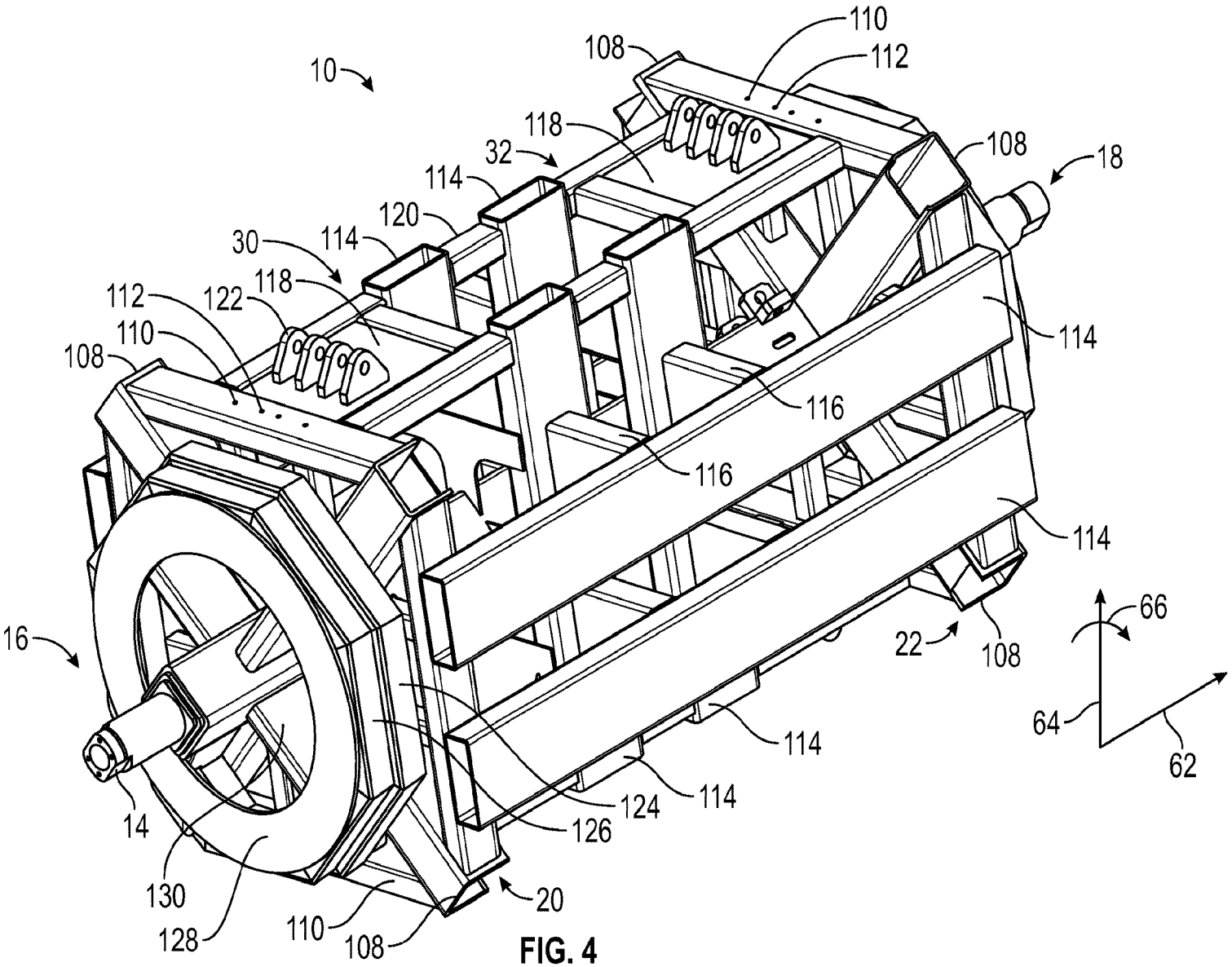
FIG. 4 is a perspective view of a portion of a drum assembly according to embodiments of the present disclosure.

FIG. 4 illustrates a perspective view of a portion of an embodiment of the drum assembly 10. The plurality of drum segments 24 are omitted to better illustrate internal details of the drum assembly 10. In addition, the drum assembly 10 may utilize various mechanical actuators or hydraulic cylinders to move the plurality of drum segments 24 between the retracted position and the extended position and these components are not shown in FIG. 4 for clarity. As shown in FIG. 4, the support bar 14 coincides with the center axis of the drum assembly 10 and provides support for other components of the drum assembly 10, such as the first and second plurality of expandable spokes 20 and 22 at the first and second ends 16 and 18 respectively.

In particular, the first and second pluralities of expandable spokes 20 and 22 include a plurality of rigid spokes 108 (e.g., hollow tubes), which may be made from square tubing of steel or similar composition. The rigid spokes 108 do not move during extension of the drum assembly 10. Instead, the plurality of drum segments 24 may include square tubing that slides into and out of interiors of the plurality of rigid spokes 108 during retraction and extension of the drum assembly 10, respectively. In other embodiments, the rigid spokes 108 may have other cross-sectional shapes, such as circles or rectangles. In the illustrated embodiment, the support bar 14 may be made from square tubing of steel or similar composition. In other embodiments, the support bar 14 may have other cross-sectional shapes, such as circles or rectangles.

In certain embodiments, a plurality of spoke frames 110 may be used to provide cross-support to the first and second pluralities of expandable spokes 20 and 22. The plurality of spoke frames 110 may be rods, beams, columns, or similar objects coupled between each of the first plurality of expandable spokes 20 and each of the second plurality of expandable spokes 22 to provide support to the expandable spokes 20 and 22 during handling, shipment, expansion, and retraction of the drum assembly 10. The spoke frames 110 may also be made from tubing of steel or similar composition with square or other cross-sectional shapes. In certain embodiments, the spoke frames 110 may include a plurality of tapped holes 112 that are used to attach components of the first and second coupling devices 30 and 32 as described in more detail below.

In further embodiments, the drum assembly 10 may include at least two fork channels 114 that extend axially 62 and/or radially 64 along the support bar 14. The forks or tines of a forklift, truck, or similar machinery may be inserted into the fork channels 114 to enable lifting and moving the drum assembly 10. For example, fork channels 114 that extend axially 62 may be used to insert and remove the drum assembly 10 from the interior channel 68 of the coil 60. Fork channels 114 that extend radially 64 may be used to lift or set the drum assembly 10 from a truck, railcar, or similar transportation or used when access to the fork channels 114 extending axially 62 is limited or restricted. The fork channels 114 may be coupled to the support bar 14, expandable spokes 20 or 22, spoke frames 110, or other appropriate locations of the drum assembly 10. The fork channels 114 that extend radially 64 may be coupled to the fork channels 114 that extend axially 62 via one or more fork offsets 116, which may be made from tubing of steel or similar composition with square or other cross-sectional shapes.

In addition, the drum assembly 10 may include a plurality of plates 118 coupled to the spoke frames 110 and/or other structural components 120 of the drum assembly 10. The plurality of plates 118 may also be used to attach components of the first and second coupling devices 30 and 32 as described in more detail below. The structural components 120 may be coupled to the spoke frames 110 and/or fork channels 114. In addition, a plurality of plates 122 may be coupled to the plurality of plates 118 and the plates 122 may also be used to attach components of the first and second coupling devices 30 and 32 as described in more detail below.

In the illustrated embodiment, the drum assembly 10 also includes a spacer ring 124, a loading ring 126, a stop ring 128, and a plurality of supports 130 at both the first and second ends 16 and 18. These components may be coupled to one another via various techniques, such as, screws, bolts, clamps, welding, brazing, or other fastening techniques. As shown in FIG. 4, the spacer ring 124 is configured as an eight-sided ring, but in other embodiments, the spacer ring 124 may have three, four, five, six, seven, nine or more sides, or the spacer ring 124 may be circular or oval in shape. The spacer ring 124 may be used to fill a space or gap between ends of the spoke frames 110 and the first and second containment flanges 26 and 28. In other embodiments where there is no space or gap, the spacer ring 124 may be omitted. The loading ring 126 is configured as an eight-sided ring in FIG. 4, but in other embodiments, the loading ring 126 may have three, four, five, six, seven, nine or more sides. The flat sides of the loading ring 126 may engage with corresponding flat sides of the first and second containment flanges 26 and 28, thereby preventing rotation of the drum assembly 10 separate from the first and second containment flanges 26 and 28. In other words, the flat sides of the loading ring 126 help the first and second containment flanges 26 and 28 move together with the drum assembly 10 during rotation of the flexible pipe handling system 8 that occurs during deployment of the spoolable pipe 12. In other embodiments, the loading ring 126 may be circular or oval in shape and other techniques used to maintain simultaneous rotation of the first and second containment flanges 26 and 28 with the drum assembly 10. For example, various temporary fastening techniques, such as bolts, screws, pins, and so forth may be used. As shown in FIG. 4, the stop ring 128 is configured as a flat circular ring coupled to the loading ring 126 and may be used with a braking mechanism as described in detail below. In embodiments where braking is not provided or used, the stop ring 128 may be omitted. In certain embodiments, the braking mechanism may be configured to engage with the loading ring 126 and the stop ring 128 may be omitted. Finally, the plurality of supports 130 may be coupled to the support bar 14 and/or the plurality of rigid spokes 108 and used to couple the spacer ring 124 and/or loading ring 128 to the drum assembly 10.

The various components of the drum assembly 10 described above may be coupled to one another via various techniques, such as, screws, bolts, clamps, welding, brazing, or other fastening techniques. In addition, although one embodiment of the drum assembly 10 is shown in FIG. 4, other configurations are possible that provide the same or similar functionality.

Figure 5:
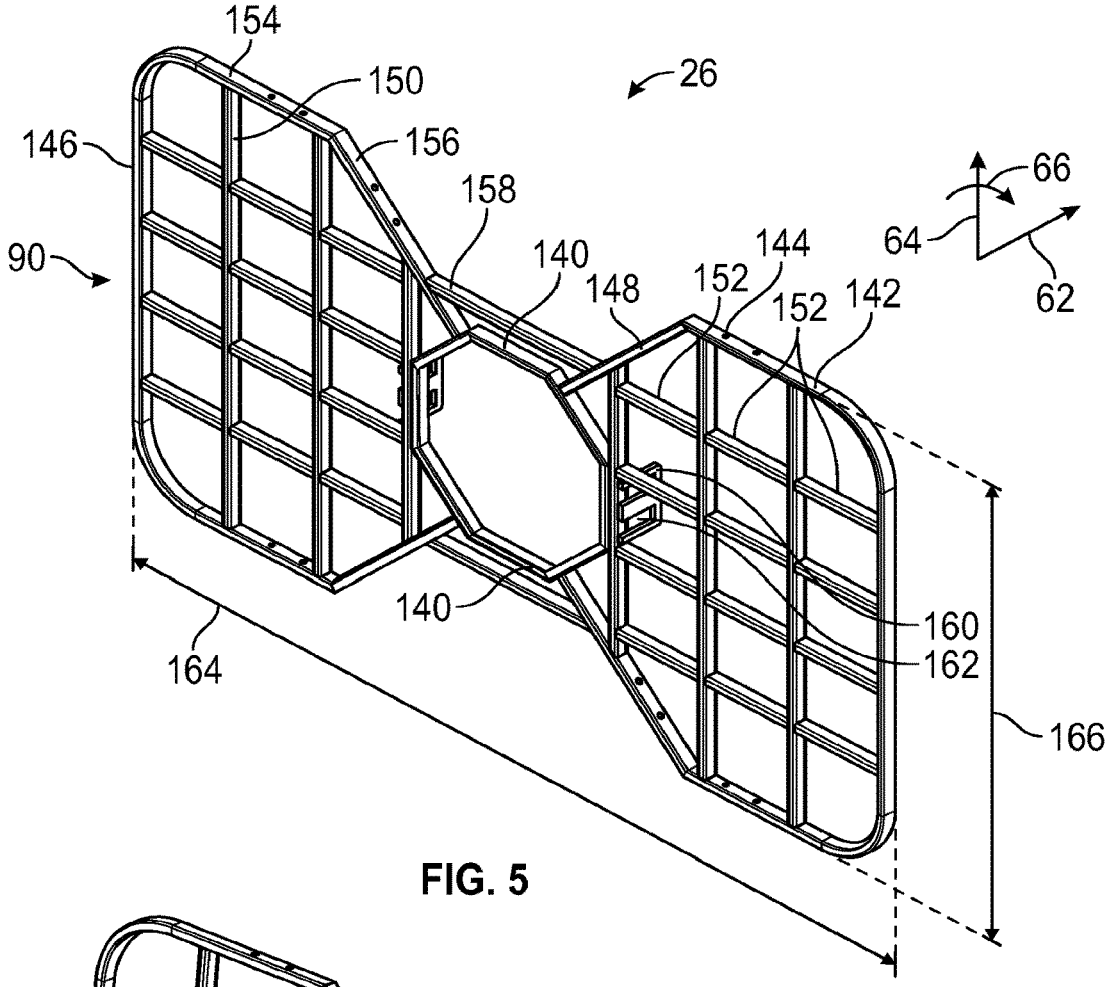
FIG. 5 is a front perspective view of a containment flange according to embodiments of the present disclosure.

FIG. 5 illustrates a front perspective view of the first containment flange 26, although the following discussion also applies equally to the second containment flange 28. As mentioned previously, the first containment flange 26 may be configured in an open framework that includes a plurality of beams 90 coupled to one another. In the illustrated embodiment, the first containment flange 26 includes a plurality of beams 140 that couple together to form an octagonal ring corresponding to the loading ring 126 of the drum assembly 10. The octagonal ring of the first containment flange 26 is larger in diameter than the loading ring 126 and thus, fits around or over the loading ring 126. In addition, the flat sides of the plurality of beams 140 engage with the flat sides of the loading ring 126 to help the first containment flange 26 to move together with the drum assembly 10. If the loading ring 126 has a different number of sides (e.g., three, four, five, six, seven, nine or more sides), then the number beams 140 may be adjusted to form a ring with the appropriate number of sides. As with all of the components of the first containment flange 26, the plurality of beams 140 may be coupled to one another via various techniques, such as, screws, bolts, clamps, welding, brazing, or other fastening techniques.

The first containment flange 26 also includes four top or bottom beams 142 that includes holes 144 that can be used to couple the containment flange extension 92 to the first containment flange 26, such as via screws or bolts. In addition, the first containment flange 26 includes two side beams 146, two middle beams 148, and four vertical beams 150 to provide vertical structure to the first containment flange 26. The first containment flange 26 also includes a plurality of horizontal beams 152 to provide horizontal structure to the first containment flange 26. As shown in FIG. 5, the first containment flange 26 includes four corner beams 154 that couple together the top or bottom beams 142 with the side beams 146. The first containment flange 26 includes four diagonal beams 156 that couple together the top or bottom beams 142 with the plurality of beams 140. Two horizontal beams 158 couple the diagonal beams 156 on the top to each other and similarly couple the diagonal beams 156 on the bottom to each other. In this context, top and bottom are used to refer to the components as shown in FIG. 5, but in general, the first containment flange 26 is symmetrical so that a component shown at the top may be located at the bottom if the first containment flange 26 is rotated 180 degrees about the axial axis 62. Finally, the first containment flange 26 includes two catches 160 made from plates coupled to the middle beams 148. As described in more detail below, the catches 160 are configured to removably couple with the first coupling device 30 of the drum assembly 10. In particular, openings 162 in the catches removably couple with a lever of the first coupling device 30. In general, the first containment flange 26 is designed with a length 164 that is approximately equal to the diameter 73 of the coil 60, thereby providing support to the circular bases 78 and 80 of the coil 60 during deployment of the spoolable pipe 12. A height 166 of the first containment flange 26 may be less than the length 164 to reduce the overall weight and cost of the first containment flange 26, and to simplify handling of the first containment flange 26. In particular, the first containment flange 26 may be coupled to the drum assembly 10 with the support bar 14 located closer to the ground than if the height 166 was the same as the length 164. Although one particular arrangement of components is shown in FIG. 5 for the first containment flange 26, other embodiment may have different shapes, components, arrangements, and so forth to accomplish the same tasks of removably coupling to the drum assembly 10 and providing containment of the spoolable pipe 12 of the coil 60.

Figure 6:
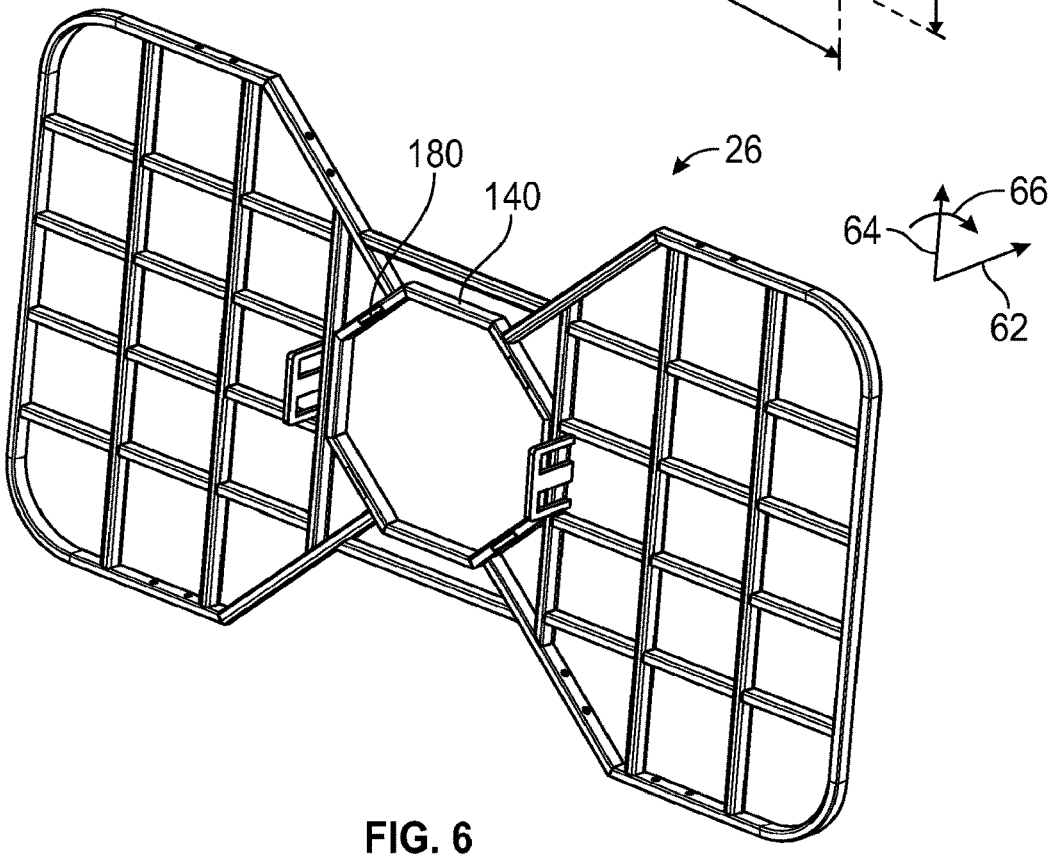
FIG. 6 is a rear perspective view of a containment flange according to embodiments of the present disclosure.

FIG. 6 illustrates a rear perspective view of an embodiment of the first containment flange 26, although the following discussion also applies equally to the second containment flange 28. In the illustrated embodiment, four spacer plates 180 are coupled to four of the plurality of beams 140 to help prevent the plurality of rigid spokes 150 from contacting or rubbing against the plurality of beams 140 during deployment of the spoolable pipe 12. In other embodiments, the spacer plates 180 may be omitted or other materials, such as plastic or foam, used to protect the surface of the first containment flange 26.

Figure 7:
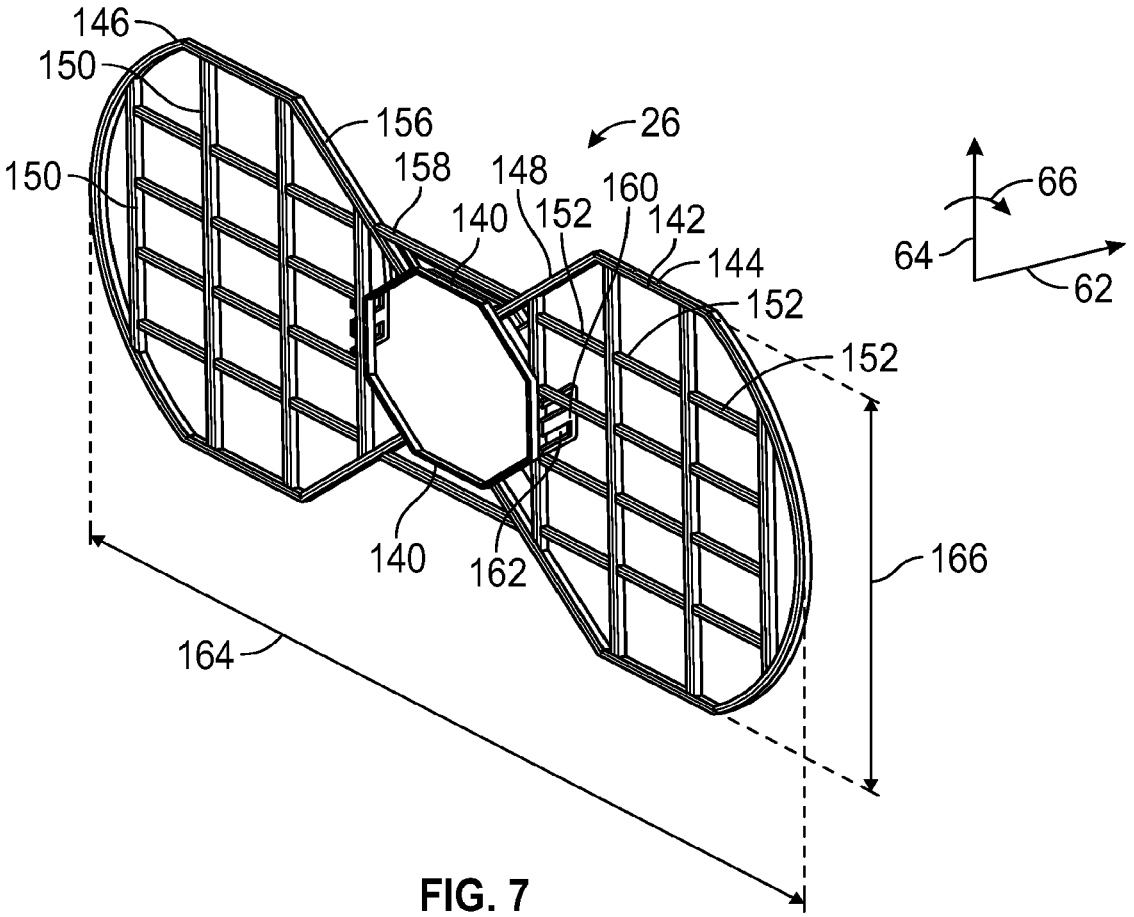
FIG. 7 is a front perspective view of a containment flange according to embodiments of the present disclosure.
Figure 8:
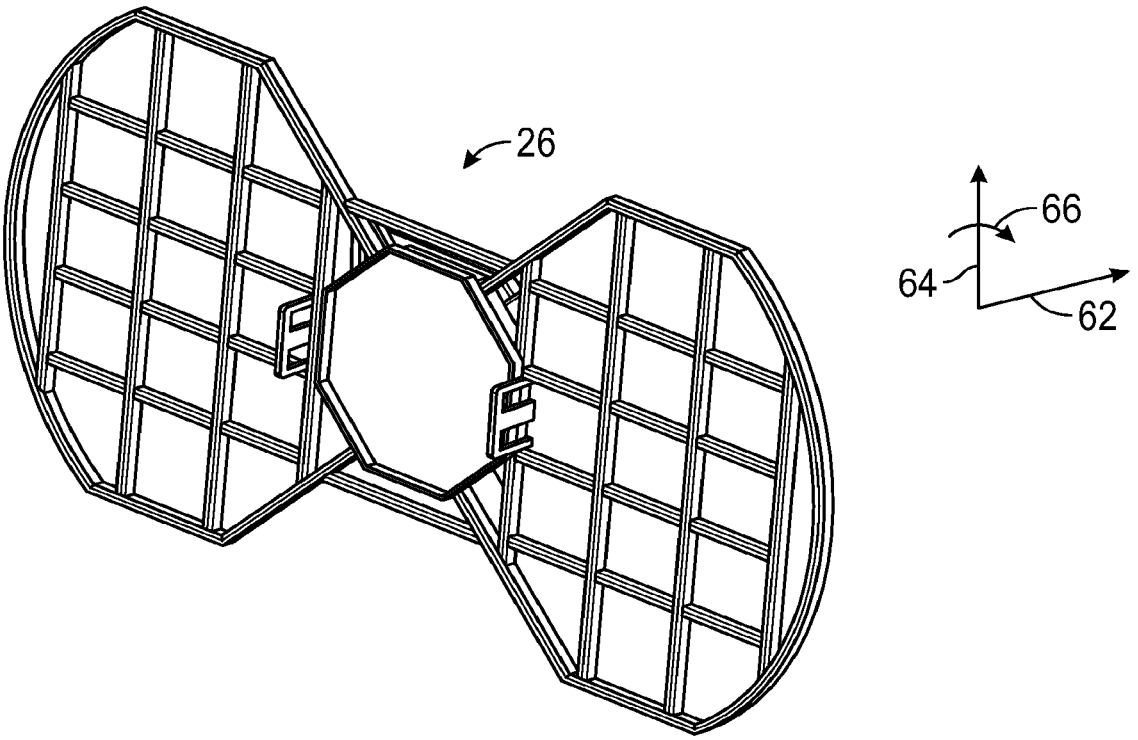
FIG. 8 is a rear perspective view of a containment flange according to embodiments of the present disclosure.

FIG. 7 illustrates a front perspective view of another embodiment of the first containment flange 26, although the following discussion also applies equally to the second containment flange 28. Elements in common with those shown in FIG. 5 are labeled with the same reference numerals. The first containment flange 26 shown in FIG. 7 is similar to that shown in FIG. 5, but has a different overall shape. In particular, the two side beams 146 are curved instead of being straight as shown in FIG. 5. In addition, two additional vertical beams 150 are included to support the additional area provided by the curved side beams 146. The illustrated embodiment of the first containment flange 26 may provide additional support to the coil 60 near the outermost layer 74 of the coil 60. FIG. 8 illustrates a rear perspective view of the embodiment of the first containment flange 26 shown in FIG. 7.

Figure 9:
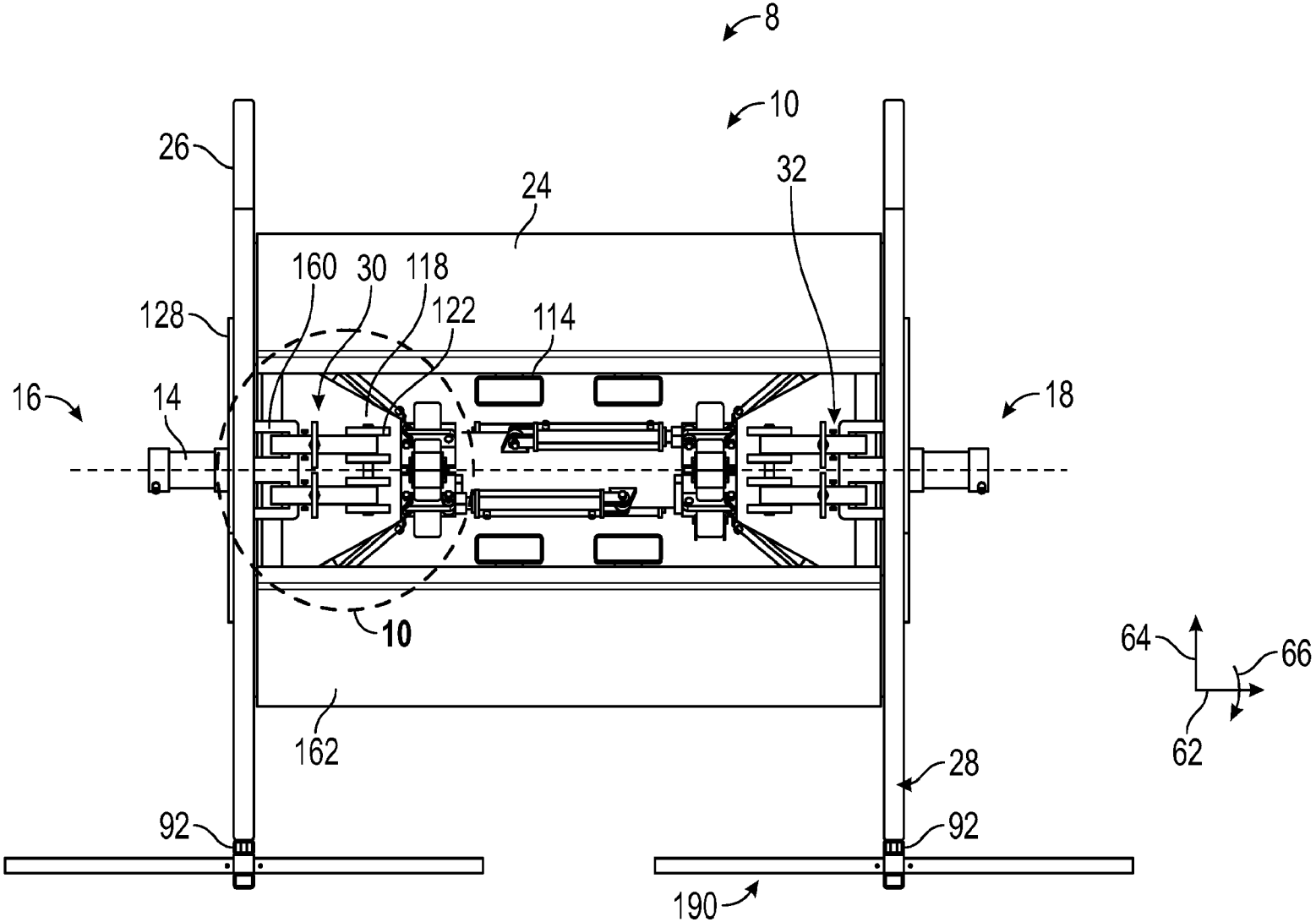
FIG. 9 is a side view of a flexible pipe handling system with containment flanges coupled to a drum assembly via coupling devices according to embodiments of the present disclosure.

FIG. 9 illustrates a side view of the flexible pipe handling system 8 with the first and second containment flanges 26 and 28 coupled to the drum assembly 10 via the first and second coupling devices 30 and 32, details of which are described in further detail below. In the illustrated embodiment, a coil containment leg 190 is inserted into each of the containment flange extensions 92 to maintain the first and second containment flanges 26 and 28 in upright positions. The coil containment legs 190 may be removably coupled to the containment flange extensions 92 via various temporary fastening techniques, such as clevis pins, cotter pins, bolts, screws, and so forth. During transport or when maintaining the first and second containment flanges 26 and 28 in upright positions is no longer needed, the coil containment legs 190 may be removed from the containment flange extensions 92. In other embodiments, different techniques may be used to maintain the first and second containment flanges 26 and 28 in upright positions, such as stakes, kickstands, chains, ropes, straps, and so forth. FIG. 9 also illustrates how the first and second containment flanges 26 and 28 are in close proximity to the plurality of drum segments 24, thereby helping to prevent any of the spoolable pipe 12 from falling into spaces or gaps between the first and second containment flanges 26 and 28 and the plurality of drum segments 24.

Figure 10:
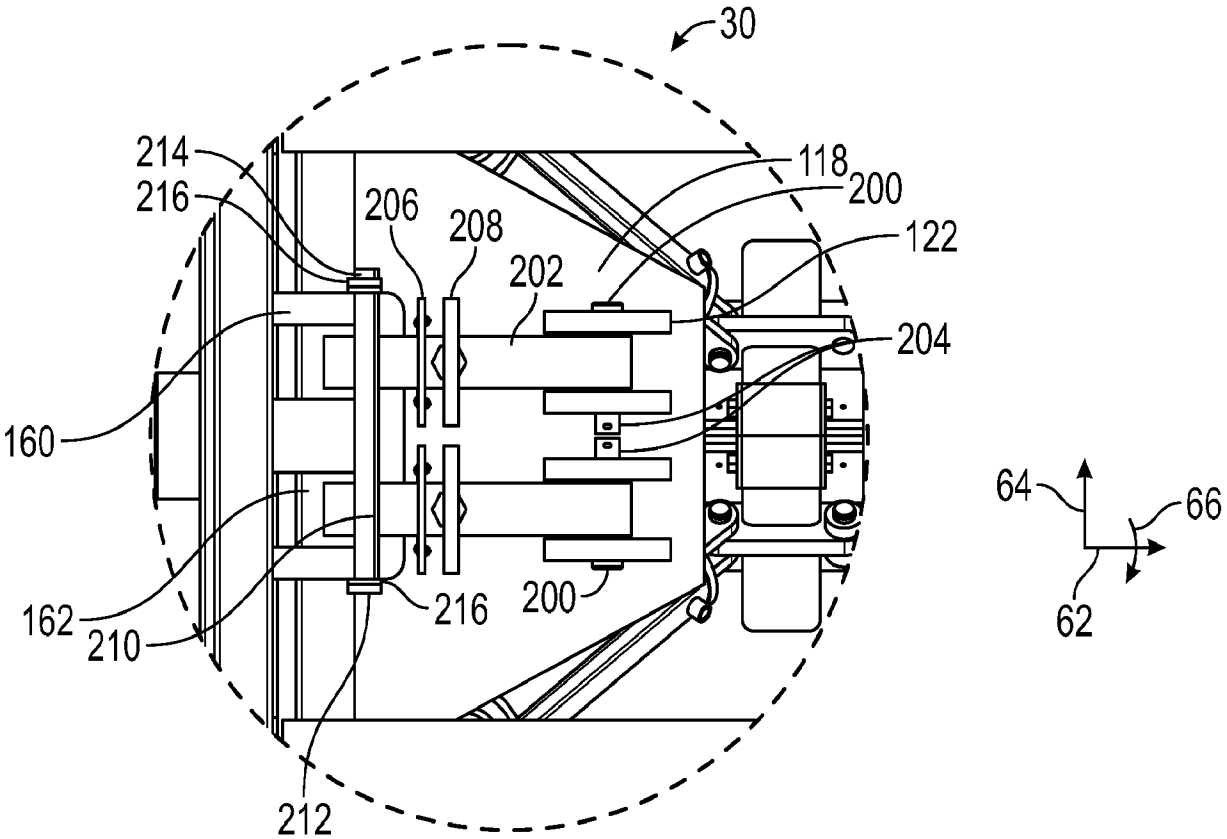
FIG. 10 is a side view of a coupling device according to embodiments of the present disclosure.

FIG. 10 illustrates a side view of an embodiment of the first coupling device 30, although the following discussion also applies equally to the second coupling device 32. In the illustrated embodiment, a clevis pin 200 passes through each pair of plates 122 to secure a latch 202 (e.g., a duck head latch) to the first coupling device 30. In the illustrated embodiments, each pair of plates 122 has a separate clevis pin 200, but in other embodiments, one clevis pin 200 may pass through both pair of plates 122. A cotter pin 204 may be used to hold each clevis pin 200 in place. Thus, the latch 202 may be free to rotate about the clevis pins 200. A pair of stud anchors 206 may be coupled to the latch 202 and used to secure a pair of springs (not shown) to the plate 118. A jackscrew 208 may be coupled to the latch 202 near the stud anchors 206 and used to disengage the latch 202 from the catch 160. Operation of the latch 202 is described in more detail below. Although two latches 202 are shown in FIG. 10, other embodiments of the coupling device 30 may include different numbers of latches 202, such as one, three, or more, depending on component weights and other operational constraints of the flexible pipe handling system 8.

In certain embodiments, a stake 210 may be used to block the latch 202 from disengaging from the catch 160. In certain embodiments, the stake 210 may be a rod with a circular or other cross-sectional shape. As shown in FIG. 10, the stake 210 includes a head 212 and a cotter pin 214. The catch 160 may include brackets 216 through which the stake 210 is inserted and kept in place via the head 212 and cotter pin 214. Operation of the stake is described in more detail below.

Figure 11:
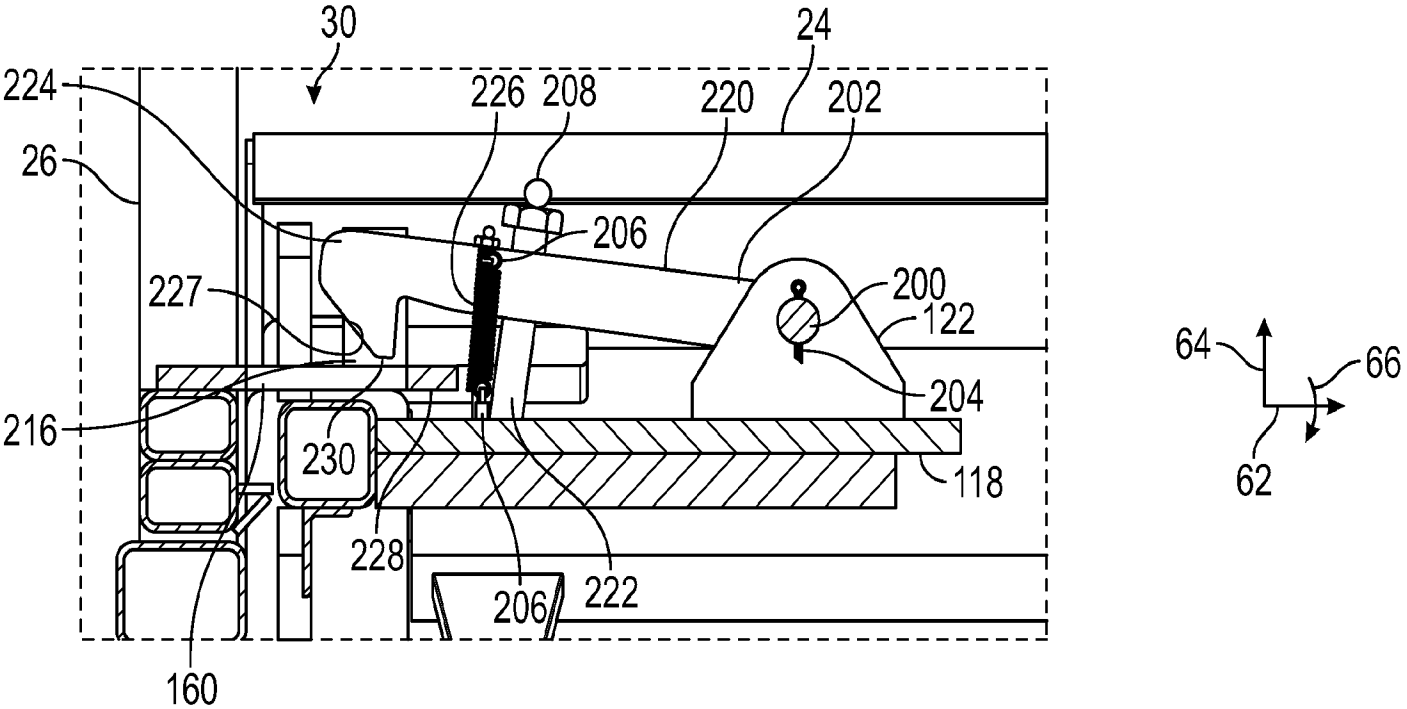
FIG. 11 is a side cross-sectional view of a coupling device according to embodiments of the present disclosure.

FIG. 11 illustrates a side cross-sectional view of the first coupling device 30, although the following discussion also applies equally to the second coupling device 32. In the illustrated embodiment, the first coupling device 30 is shown in an unlocked position. In this position, the first containment flange 26 may be uncoupled from the drum assembly 10. As shown in FIG. 11, the jackscrew 208 has been turned or rotated to move the latch 202 radially 64 away from the catch 160 of the first containment flange 26. In other words, rotation of the jackscrew 208 in a first direction in a threaded opening 220 of the latch 202 causes the jackscrew 208 to move down through the threaded opening 220. However, since an end 222 of the jackscrew 208 is confined against the surface of the plate 118, the rotation of the jackscrew 208 in the first direction causes the latch 202 to move up away from the plate 118. With the latch 202 in the unlocked position, a duck head portion 224 of the latch 202 is no longer engaged against the catch 160. Thus, the first containment flange 26 and catch 160 are free to move axially 62 away from the drum assembly 10. The jackscrew 208 is used to disengage the latch 202 because springs 226 coupled to the stud anchors 206 normally bias the latch 202 in a locked position as described in detail below. In certain embodiments, the stud anchors 206 are inserted into the tapped holes 112 shown in FIG. 4. As shown more clearly in FIG. 10, two springs 226 may be used with each latch 202, although in other embodiments, one, three, four or more springs 226 may be used depending on the requirements of the flexible pipe handling system 8. In the illustrated embodiment, the stake 210 cannot be seen, but a portion of the bracket 216 coupled to the catch 160 and through which the stake 210 is inserted is visible. In further embodiments, different configurations of the latch 202 may be used that include different components or components in different locations than that shown in FIG. 11.

Figure 12:
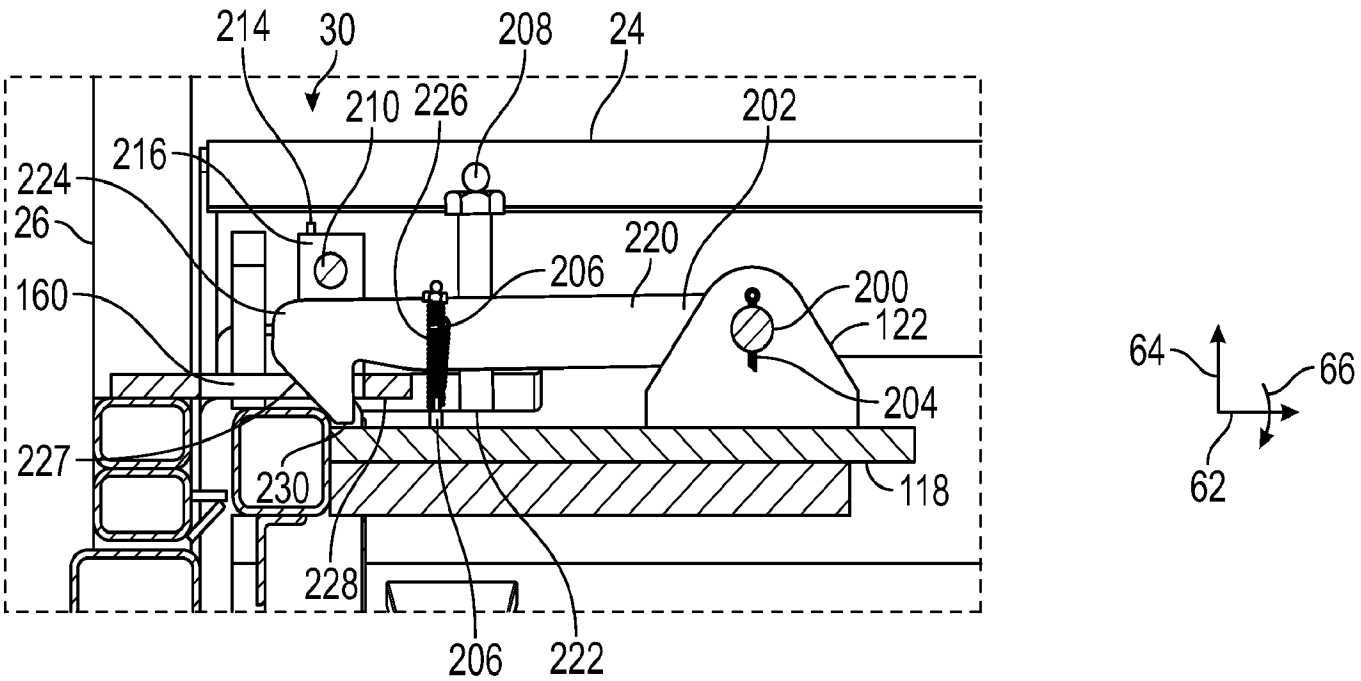
FIG. 12 is a side cross-sectional view of a coupling device according to embodiments of the present disclosure.

FIG. 12 illustrates a side cross-sectional view of the first coupling device 30, although the following discussion also applies equally to the second coupling device 32. In the illustrated embodiment, the first coupling device 30 is shown in a locked position. In this position, the first containment flange 26 may be coupled to the drum assembly 10. As shown in FIG. 11, the jackscrew 208 has been turned or rotated in a second direction opposite from the first direction so the end 222 of the jackscrew 208 is no longer in contact with the plate 118. Thus, the jackscrew 208 is no longer causing the latch 202 to move away from the plate 118. Instead, the springs 226 bias the latch 202 toward the plate 118 so that the duck head portion 224 is engaged against the catch 160, thereby maintaining the first containment flange 26 coupled to the drum assembly 10. As shown more clearly in FIG. 10, the duck head portion 224 is located in the opening 162 of the catch 160. In the illustrated embodiment of FIG. 12, the duck head portion 224 includes an angled surface 227 that is configured to contact a leading edge 228 of the plate 118 when the first containment flange 26 is moved axially 62 toward the drum assembly 10. As the first containment flange 26 continues to move axially 62 toward the drum assembly 10, the angled surface 227 causes the duck head portion 224 to move radially 64 away from the plate 118 until the springs 226 cause the duck head portion 224 to move into the opening 162 of the catch 160 when a tip 230 of the duck head portion 224 reaches the opening 162, thereby locking the first containment flange 26 to the drum assembly 10. In certain embodiments, the stake 210 is inserted into the brackets 216 and held in place via the cotter pin 214. As shown in FIG. 12, the stake 210 blocks radial 64 movement of the duck head portion 224 out of the catch 160. Although the springs 226 are configured to bias the latch 202 closed, the stake 210 may be used as a secondary or back-up method of preventing the latch 202 from opening. The process described above with respect to FIG. 11 is used to remove the first containment flange 26 from the drum assembly 10. Specifically, the stake 210 may be removed from the brackets 216 to enable the duck head portion 224 to move out of the catch 160 when the jackscrew 208 is rotated in the second direction.

Figure 13:
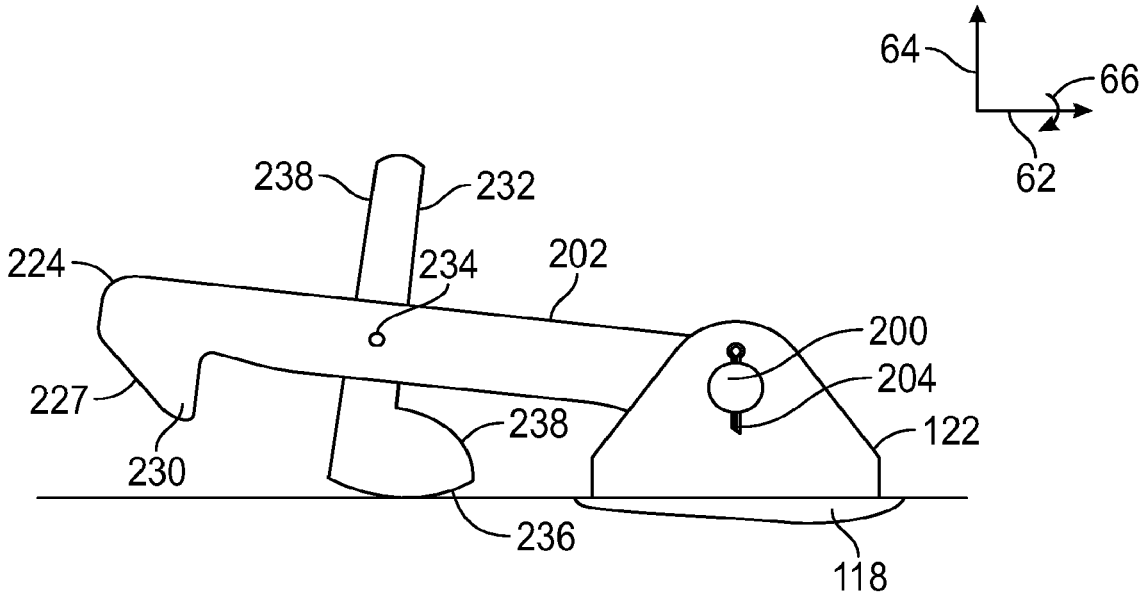
FIG. 13 is a perspective view of a flexible pipe handling system as used with an A-frame according to embodiments of the present disclosure.

FIG. 13 illustrates a side cross-sectional view of the latch 202 that does not include the jackscrew 208. Instead, a cam 232 is used to move the latch 202 away from the plate 118. Specifically, the cam 232 is coupled to the latch 202 via a hinge 234 that enables the cam 232 to rotate about the hinge 234 with respect to the latch 202. The cam 232 includes a curved surface 236 that slides against the plate 118 and a handle 238 to enable an operator to rotate the cam 232. As shown in FIG. 13, when the curved surface 236 is against the plate 118, the position of the cam 232 forces the latch 202 away from the plate 118.

Figure 14:
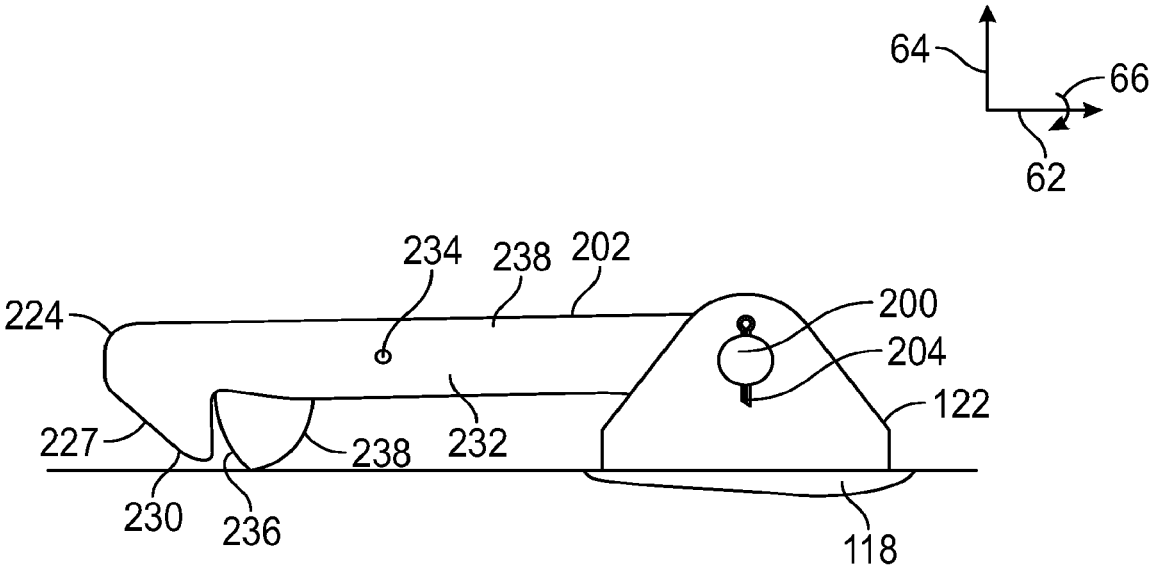
FIG. 14 is a top view of a support bar engaged with a bearing of an A-frame according to embodiments of the present disclosure.

FIG. 14 illustrates a side cross-sectional view of the latch 202 in a closed position using the cam 232. As shown in FIG. 14, the cam 232 has been rotated radially 66 about the hinge 234 such that the curved surface 236 is no longer in contact with the plate 118. Instead, a second curved surface 238 is now in contact with the plate 118. In this position of the cam 232, the latch 202 is in the closed position. Thus, the cam 232 provides an alternative method of moving the latch 202 between open and closed positions. Other configurations of the cam 232 and other techniques may also be used to move the latch 202 with respect to the plate 118.

Figure 15:
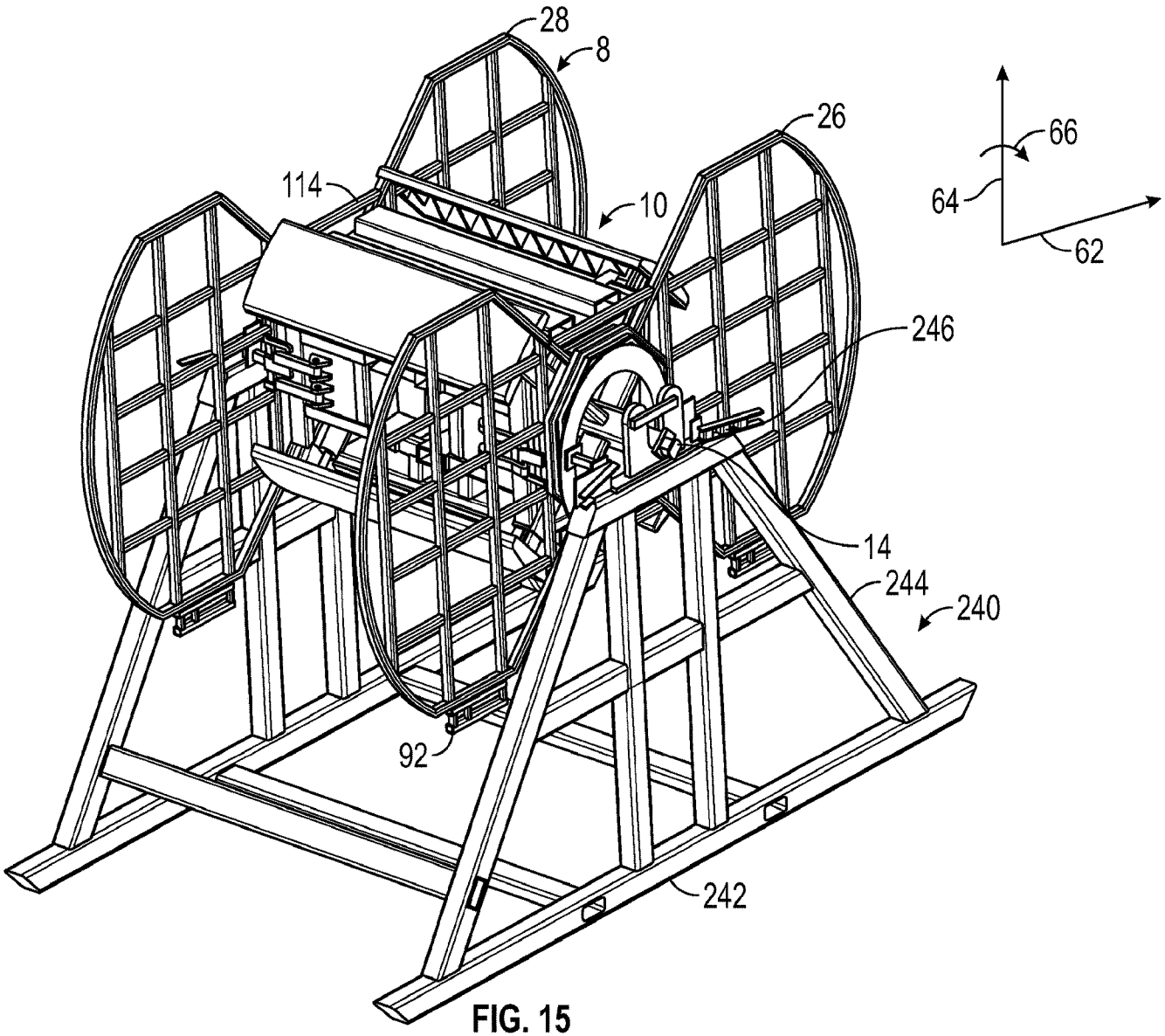
FIG. 15 is a top view of a braking mechanism to be used with an A-frame according to embodiments of the present disclosure.

FIG. 15 illustrates a perspective view of an embodiment of the flexible pipe handling system 8 as used with an embodiment of an A-frame 240, which may be a stationary device placed on the ground and used for deploying the spoolable pipe 12. In certain embodiments, the A-frame 240 may be placed on a moving platform (e.g., truck, lowboy, etc.) to enable mobile deployment of the spoolable pipe 12. The A-frame 240 provides a platform 242 for various beams 244 that are coupled to a bearing 246 configured to engage the support bar 14 of the drum assembly 10. The bearing 246 may utilize various friction-reducing techniques to enable the support bar 14 to rotate freely in the bearing 246. For example, the bearing 246 may include bushings made from steel or aluminum-bronze to provide improved wear resistance. The flexible pipe handling system 8 may be lowered into the A-frame 240 via the fork channels 114 or straps coupled to the support bar 14. Operation of the flexible pipe handling system 8 with the A-frame 240 is described in more detail below. Although one embodiment of the A-frame 240 is shown in FIG. 15, it is understood that the flexible pipe handling system 8 may be used with a variety of different A-frames and other types of deployment equipment as described below.

Figure 16:
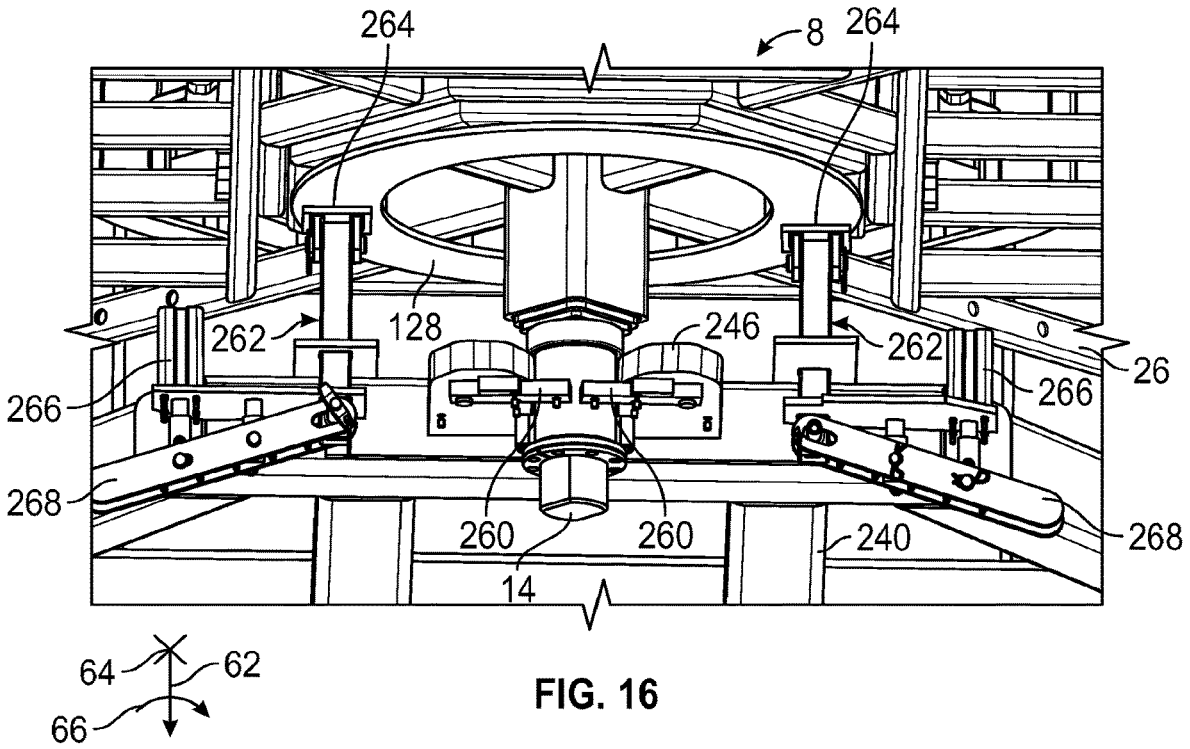
FIG. 16 is a perspective view of an installation trailer that may be used with a flexible pipe handling system according to embodiments of the present disclosure.

FIG. 16 illustrates a top view of an embodiment of the support bar 14 engaged with the bearing 246 of the A-frame 240. In the illustrated embodiment, the support bar 14 sits within the bearing 246. In certain embodiments, the bearing 246 may include one or more keepers 260 configured to block the support bar 14 from inadvertently coming out of the bearing 246. When removal of the flexible pipe handling system 8 from the A-frame 240 is desired, the keepers 260 may be manually or automatically moved out of the way to enable the support bar 14 to come out of the bearing 246. As shown in FIG. 16, the A-frame 240 may include a braking mechanism 262 to be used with the stop ring 128 of the flexible pipe handling system 8. In the illustrated embodiment, the braking mechanism 262 includes a brake pad 264 to engage with the stop ring 128. The brake pad 264 may be made from a variety of materials selected to provide increased friction when engaged with the stop ring 128. An actuator 266 may work together with a linkage 268 to move the brake pad 264 axially 62 toward or away from the stop ring 128. Although the braking mechanism 262 shown in FIG. 16 includes two brake pads 264 and associated equipment, one, three, four or more brake pads 264 and associated equipment may be used in other embodiments. The braking mechanism 262 may be used to apply back tension to the spoolable pipe 12 while the spoolable pipe 12 is being deployed by the flexible pipe handling system 8, thereby preventing undesired unspooling, free-spooling, or backlash of the spoolable pipe 12.

Figure 17:
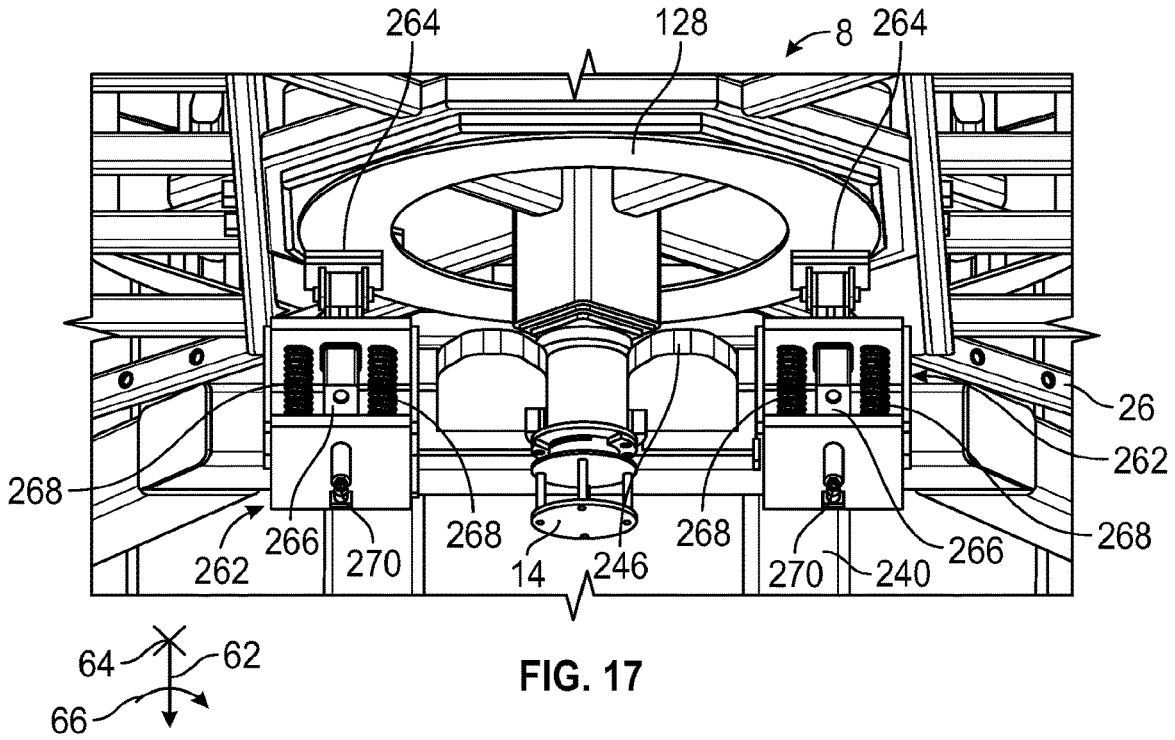
FIG. 17 is a perspective view of an installation trailer that may be used with a flexible pipe handling system according to embodiments of the present disclosure.

FIG. 17 illustrates a top view of another embodiment of the braking mechanism 262 to be used with the A-frame 240. In the illustrated embodiment, the braking mechanism 262 does not include the linkage 268 shown in FIG. 16. Instead, the actuator 266 acts directly in the axial direction 62 against the stop ring 128. In certain embodiments, the braking mechanism 262 includes one or more springs 268 to move the brake pad 264 away from the stop ring 128 when the actuator 266 is not being used to move the brake pad 264 against the stop ring 128. In other words, the springs 268 bias the brake pad 264 away from the stop ring 128. In addition, the braking mechanism 262 may include a hydraulic connection 270 to enable hydraulic or other fluid to be supplied to the actuator 266. The hydraulic connection 270 may be coupled to a hand pump or other device to control the supply of hydraulic fluid to the actuator 266. In further embodiments, other types of braking mechanism or techniques may be used including, but not limited to, caliper brakes, drum brakes, eddy current brakes, and so forth.

Figure 18:
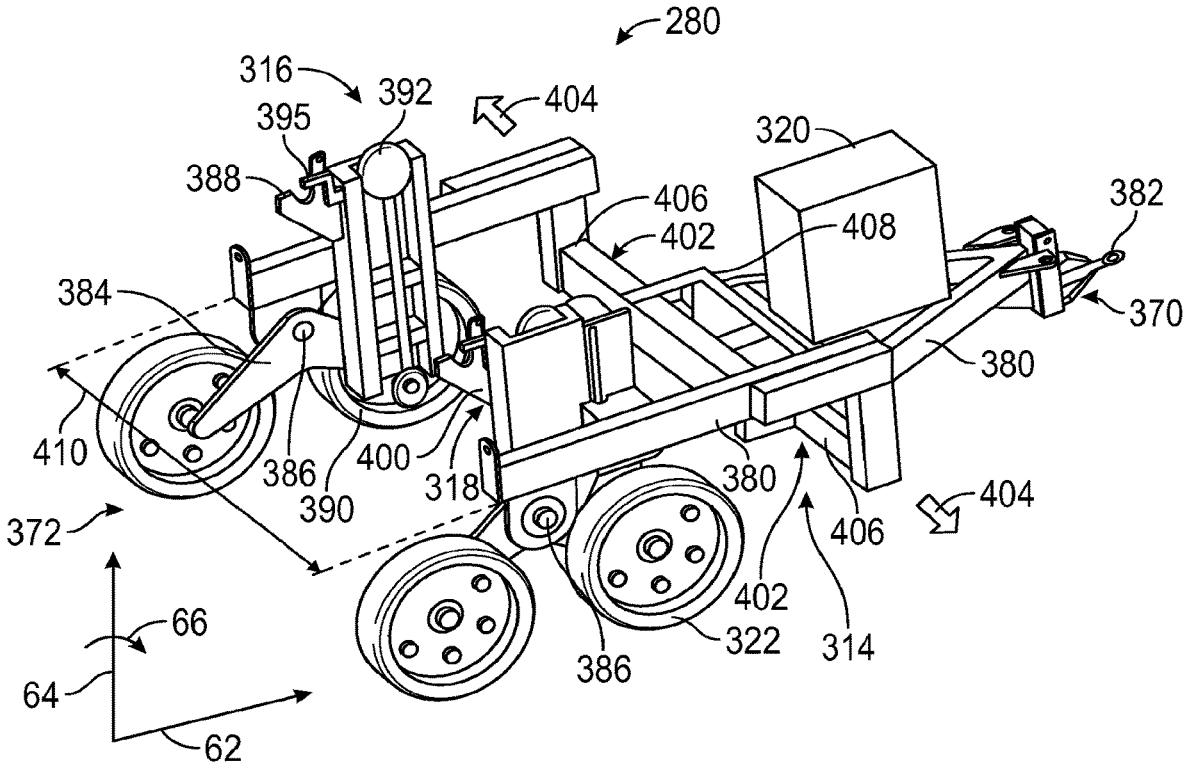
FIG. 18 illustrates a perspective view of an embodiment of an installation trailer that may be used with embodiments of the flexible pipe handling system.

FIG. 18 illustrates a perspective view of an embodiment of an installation trailer 280 that may be used with embodiments of the flexible pipe handling system 8. In the illustrated embodiment, the installation trailer 280 has a front side 370 and a rear side 372. A trailer frame 314 is made from several structural members 380 coupled to one another such that the trailer frame 314 may support the other components of the installation trailer 280 and the weight of the coil 60 and flexible pipe handling system 8, which may exceed 40,000 pounds (18,144 kilograms), or exceed 60,000 pounds (27,216 kilograms). For example, the structural members 380 may be made from square steel tubing, steel I-beams, sheet metal, or similar composite structural members. The trailer frame 314 may include a trailer connection point 382, which may be a hitch, such as a draw bar hitch. A draw bar hitch may be a type of tow hitch that includes a ball extending from a bar and configured to secure a hook or a socket combination for the purpose of towing or being towed. Those of ordinary skill in the art will appreciate that other types of tow hitches and attachment systems may be used to attach another vehicle to the installation trailer 280. In other embodiments, the trailer connection point 382 may be configured as a breakaway hitch so that electric brakes for the installation trailer 280 may be activated if the installation trailer 280 becomes disconnected from the tow vehicle for some reason.

Accordingly, a vehicle (not shown) may be fitted with a connector or attachment system known to those of ordinary skill in the art for connecting to the installation trailer 280. In one or more embodiments, a vehicle used to tow the installation trailer 280 may include without limitation, a dozer, a front-end loader, or excavator, for example, when the installation trailer 280 is fully loaded with the coil 60, or by standard trucks, automobiles, or other vehicles, for example, when the installation trailer 280 is in an unloaded state (i.e. is not carrying the coil 60). The installation trailer 280 may be further designed for off-road use by selecting wheels 322 appropriate for off-road use. In some embodiments, the wheels 322 may be wide base tires (e.g., super single tires) coupled to heavy duty hubs. Thus, the installation trailer 280 may be adapted for use with many types of roads and terrains. In the illustrated embodiment, the two wheels 322 on each side may be coupled to a frame 384 that tilts about a pivot 386 to enable the installation trailer 280 to move easily over uneven terrain. In certain embodiments, the installation trailer 280 is capable of deploying the spoolable pipe 12 by means of towing the installation trailer 10 along a pipeline path or keeping the installation trailer 280 stationary and pulling the spoolable pipe 12 off the installation trailer 280.

As shown in FIG. 18, a lifting mechanism 316 may be used to raise and lower coils 60 via support bar 14 of the flexible pipe handling system 8 with the use of two "j-shaped" hooks 388. The lifting hooks 388 may be raised and lowered by use of hydraulic cylinders 390 capable of lifting or lowering coils 60 that may exceed 40,000 pounds (18,144 kilograms), or exceed 60,000 pounds (27,216 kilograms). In certain embodiments, the hydraulic cylinders 390 may be coupled directly to the lifting hooks 388. In other embodiments, the hydraulic cylinders 390 may be coupled indirectly to the lifting hooks 388. For example, one or more sheaves 392 or pulleys and an appropriate belt 394, rope, wire, cable, chain, or other tension bearing member used to provide mechanical advantage and/or redirect the direction of motion of the hydraulic cylinders 390. In certain embodiments, the lifting mechanism 316 may have a 2:1 ratio, a 3:1 ratio, or better. As shown in FIG. 18, the lifting mechanism 316 is configured to move the lifting hooks 388 and the corresponding coil 30 in a perpendicular direction to the axial axis 62 (e.g., vertically). In other embodiments, the lifting mechanism 316 may be disposed at an angle to the axial axis 62, thereby moving the coil 60 at an angle to the horizontal direction. In further embodiments, the lifting hooks 388 may have shapes other than a "j-shape." For example, each lifting hook 388 may have a circular opening to accommodate the support bar 14 used to manipulate flexible pipe handling system 8 and coil 60.

In certain embodiments, a vertical stop 395 may be used with the lifting hook 388. When the support bar 14 is located in the lifting hook 388 and the lifting hook 388 is raised toward the vertical stop 395 by the lifting mechanism 316, the vertical stop 395 may be used to block the support bar 14 from inadvertently coming or falling out of the lifting hook 388, for example if the installation trailer 280 were to encounter a bump during movement or deployment of the spoolable pipe 12. Thus, the vertical stop 395 provides this safety feature without having an operator climb onto the installation trailer 280 or use a ladder to install or move a similar safety retainer into place. Instead, the vertical stop 395 provides this feature when the lifting mechanism 316 is in the deployment position (e.g., when the lifting hook 388 is located at its topmost position). In other embodiments, the vertical stop 395 may be coupled to the lifting hook 388 and move vertically together with the lifting hook 388. In such embodiments, the vertical stop 395 may be coupled to the lifting hook 388 via a hinge or similar connection to enable the vertical stop 395 to be moved into an appropriate position to block undesired movement of the shaft.

In the illustrated embodiment, the braking mechanism 318 may include a caliper brake 396 that includes one or more calipers 398 disposed against a rotor 400, which may be coupled to the lifting mechanism 316. The caliper brake 396 may be used to slow or stop rotation of the coil 60 during deployment, thereby helping to prevent undesired unspooling, free-spooling, or backlash of the spoolable pipe 12. Those of ordinary skill in the art will appreciate that other types of braking mechanisms, such as, but not limited to, frictional brakes, disc brakes, drum brakes, electromagnetic brakes, or hydraulic motors, may be used to provide braking of the coil 60. In some embodiments, the braking mechanism 318 may be configured to provide braking directly to the flexible pipe handling system 8 via the stop ring 128. For example, the braking mechanism 318 may grip or directly contact the stop ring 128 to provide the braking force similar to one of the braking mechanisms 262 of the A-frame 240 shown in FIGS. 16 and 17. Thus, the braking mechanism 318 applies pressure to the spoolable pipe 12 via the stop ring 128. In further embodiments, a motor or similar device may be added to the braking mechanism 318 or to the installation trailer 280 to provide respool capability. In other words, the motor may rotate the flexible pipe handling system 8 in an opposite direction to that used during deployment to respool some or all of the deployed spoolable pipe 12 back onto the flexible pipe handling system 8. Such respooling capability may also be added to the A-frame 240 shown in FIGS. 16 and 17.

In the illustrated embodiment, a hydraulic power unit 320 may be coupled to the trailer frame 314 near the trailer connection point 382. For example, the hydraulic power unit 320 may include an electric-start gasoline or diesel engine, 2-stage hydraulic pump, hydraulic fluid reservoir, and gasoline reservoir configured to provide hydraulic power to the hydraulic components of the installation trailer 280, such as the hydraulic cylinders 390 of the lifting mechanism 314, the breaking mechanism 318, or other hydraulic cylinders described below. In some embodiments, the hydraulic power unit 320 may be replaced by an electric power supply and the hydraulic cylinders replaced by various types of electromechanical actuators.

In certain embodiments, the installation trailer 280 may include telescoping sides 402 configured to move in the direction of arrows 404 via one or more hydraulic cylinders disposed within the structural members 380 or coupled to the structural members 380. In other words, inner structural members 406 may have a smaller dimension (e.g., width, height, or diameter) than the outer structural members 408 to enable the inner structural members 406 to slide in or out of the outer structural members 408. One end of the hydraulic cylinders may be coupled to the inner structural members 406 and another end coupled to the outer structural members 408 to provide the motive force to move the inner structural members 406. In other embodiments, the hydraulic cylinders may be omitted and an operator may manually move the inner structural members 406 in or out of the outer structural members 408. As shown in FIG. 18, the installation trailer 280 has an expanded system width 410. In other words, the telescoping sides 402 enable the inner structural members 406 to move outward in the direction of arrows 404 to the expanded system width 410. The installation trailer 280 may be able to accommodate coils 60 when in the expanded position that would not be possible when the installation trailer 280 is in a collapsed position. In further embodiments, other techniques may be used to accomplish expanding or contracting the installation trailer 280, such as, but not limited to, hinges, joints, disassembly/reassembly, folding, expansion joints, accordion joints, and so forth. In further embodiments, one or more structural members 380 may be disposed at the rear side 372 between lengthwise structural members 380 to provide additional structural stability to the installation trailer 280. The additional structural members 380 may couple together telescopically or swing toward or away from the installation trailer 280 via hinges like a gate. Although one embodiment of the installation trailer 280 is shown in FIG. 18, it is understood that the flexible pipe handling system 8 may be used with a variety of different installation trailers.

Figure 19:
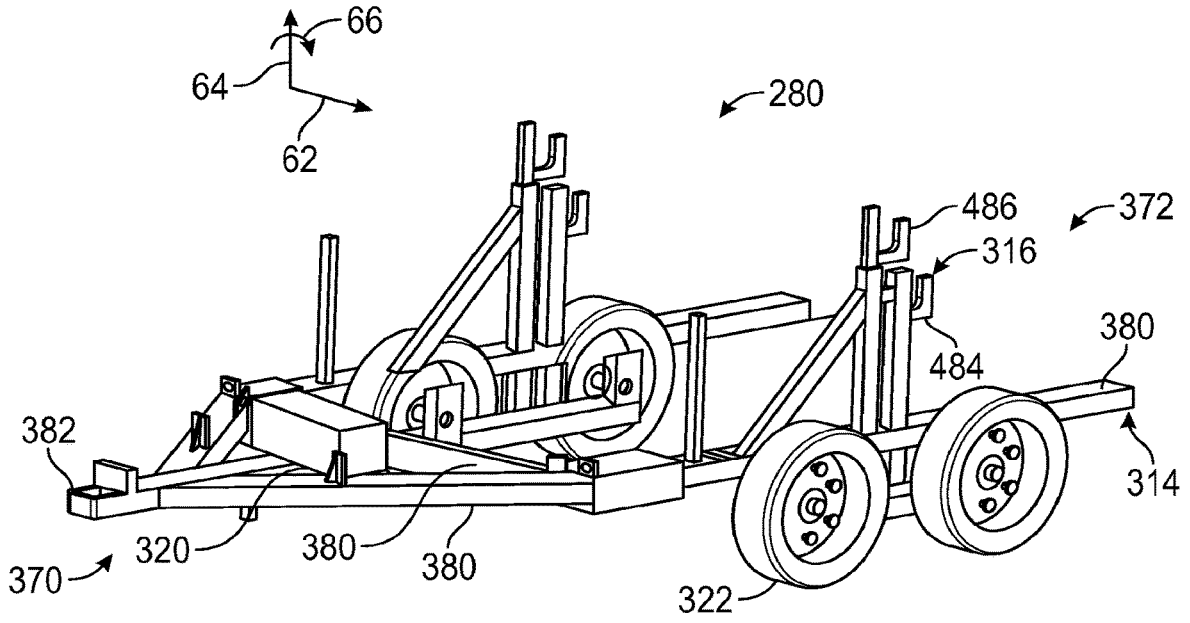
FIG. 19 illustrates a perspective view of another embodiment of the installation trailer that may be used with embodiments of the flexible pipe handling system.

FIG. 19 illustrates a perspective view of another embodiment of the installation trailer 280 that may be used with embodiments of the flexible pipe handling system 8. Elements in common with those shown in FIG. 18 are labeled with the same reference numerals. In the illustrated embodiment, the lifting mechanism 316 may be used to raise and lower the flexible pipe handling system 8 with the use of two pairs of "j-shaped" hooks. A lower set of hooks 484 can lift coils 60 with a first range of diameters (e.g., between approximately 12 to 13.5 feet) and an upper set of hooks 486 can lift coils 60 with a second range of diameters (e.g., between approximately 13.6 to 16 feet) that is greater than the first range. The two sets of lifting hooks 484 and 486 may be mechanically connected to one another and may be raised and lowered by use of hydraulic cylinders capable of lifting or lowering coils 60 that may exceed 40,000 pounds (18,144 kilograms), or exceed 60,000 pounds (27,216 kilograms). In certain embodiments, the installation trailer 280 may include one of the braking mechanisms 262 or 318 described previously with respect to the A-frame 240 shown in FIGS. 15-17 or the installation trailer 280 shown in FIG. 18 respectively.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system, comprising:

a drum assembly comprising:

a support bar; and a drum segment coupled to the support bar, wherein the drum segment is movable between a retracted position and an extended position, and the drum assembly is configured to be disposed within an interior region of a coil of flexible pipe when the drum segment is in the retracted position;

a containment flange coupled to the drum assembly, wherein the containment flange is configured to contain the flexible pipe disposed on the drum assembly;

a coupling device configured to removably couple the containment flange to the drum assembly, wherein the coupling device comprises a latch coupled to the drum assembly and is configured to engage with a catch formed in the containment flange; and a cam configured to disengage the latch from the catch.

2. The system of claim 1, comprising a hinge that couples the cam to the latch, wherein the hinge is configured to enable the cam to rotate about the hinge with respect to the latch.

3. The system of claim 2, wherein the cam comprises a handle to enable the cam to be rotated about the hinge.

4. The system of claim 1, wherein the cam comprises a first surface and a second surface.

5. The system of claim 4, wherein the drum assembly comprises:

an expandable spoke coupled to the support bar and the drum segment;

a spoke frame coupled to the expandable spoke; and a plate coupled to the spoke frame.

6. The system of claim 5, wherein the first surface of the cam is in contact with the plate when the cam is in a first position and the second surface of the cam is in contact with the plate when the cam is in a second position.

7. The system of claim 6, wherein the latch is disengaged from the catch when the cam is in the first position and the latch is engaged with the catch when the cam is in the second position.

8. The system of claim 1, comprising a spring mechanism configured to retain the latch engaged with the catch.

9. The system of claim 1, wherein the catch comprises a plate disposed orthogonal to the containment flange and comprising an opening therein, and wherein the latch comprises a duck head-shaped portion configured to engage with the opening of the catch.

10. The system of claim 9, wherein the duck head-shaped portion comprises an angled surface and a tip.

11. A method of engaging a drum assembly with a coil of flexible pipe, comprising:

disposing the drum assembly within an interior region of the coil of flexible pipe, the drum assembly comprising:

a support bar; and a drum segment coupled to the support bar, wherein the drum segment is movable between a retracted position and an extended position, and the drum assembly is configured to be disposed within an interior region of a coil of flexible pipe when the drum segment is in the retracted position;

moving the drum segment from the retracted position to the extended position;

removably coupling a containment flange to the drum assembly via a coupling device by engaging a latch coupled to the drum assembly with a catch formed in the containment flange;

containing the flexible pipe disposed on the drum assembly using the containment flange;

disengaging the latch from the catch via a cam; and uncoupling the containment flange from the drum assembly.

12. The method of claim 11, comprising rotating the cam about a hinge that couples the cam to the latch.

13. The method of claim 11, wherein the cam comprises a first surface and a second surface.

14. The method of claim 13, wherein the drum assembly comprises:

an expandable spoke coupled to the support bar and the drum segment;

a spoke frame coupled to the expandable spoke; and a plate coupled to the spoke frame.

15. The method of claim 14, comprising:

contacting the first surface of the cam with the plate when the cam is in a first position; and contacting the second surface of the cam with the plate when the cam is in a second position.

16. The method of claim 15, comprising:

disengaging the latch from the catch when the cam is in the first position; and engaging the latch with the catch when the cam is in the second position.

17. The method of claim 15, comprising retaining the latch engaged with the catch using a spring mechanism.

18. The method of claim 15, wherein the catch comprises a plate disposed orthogonal to the containment flange and comprising an opening therein, and wherein the latch comprises a duck head-shaped portion configured to engage with the opening of the catch.

19. The method of claim 18, wherein the duck head-shaped portion comprises an angled surface and a tip.

* * * * *